US008215984B2

(12) United States Patent
Yokozeki

(10) Patent No.: US 8,215,984 B2
(45) Date of Patent: Jul. 10, 2012

(54) ELECTRICAL CONNECTOR

(75) Inventor: Shuji Yokozeki, Kanagawa (JP)

(73) Assignee: Tyco Electronics Japan G.K., Kanagawa-Ken (JP)

( * ) Notice: Subject to any disclaimer, the term of this patent is extended or adjusted under 35 U.S.C. 154(b) by 0 days.

(21) Appl. No.: 13/165,998

(22) Filed: Jun. 22, 2011

(65) Prior Publication Data

US 2011/0250793 A1 Oct. 13, 2011

Related U.S. Application Data

(63) Continuation of application No. PCT/JP2009/006507, filed on Dec. 1, 2009.

(30) Foreign Application Priority Data

Dec. 26, 2008 (JP) ..... 2008-332882

(51) Int. Cl.
*H01R 13/60* (2006.01)

(52) U.S. Cl. ..... 439/540.1

(58) Field of Classification Search ..... 439/540.1, 439/541.5, 701, 717, 752
See application file for complete search history.

(56) References Cited

U.S. PATENT DOCUMENTS 5,609,503 A * 3/1997 Tsuji et al. ..... 439/752
6,059,612 A * 5/2000 Aoyama et al. ..... 439/701
6,435,921 B2 * 8/2002 Kojima et al. ..... 439/752
6,527,583 B2 3/2003 Plate
6,648,699 B1 * 11/2003 Makino et al. ..... 439/752
6,769,940 B2 * 8/2004 Nakano ..... 439/752
6,878,018 B2 * 4/2005 Miyakawa et al. ..... 439/752
6,902,443 B2 * 6/2005 Hara et al. ..... 439/752
7,114,999 B2 * 10/2006 Tsuji ..... 439/752

FOREIGN PATENT DOCUMENTS

JP 10050386 A 2/1998
JP 2000315546 A 11/2000
JP 2007324049 12/2007

OTHER PUBLICATIONS

PCT Search Report issued Dec. 21, 2009, PCT/JP2009/006507, 3 pages.

* cited by examiner

*Primary Examiner* — Tulsidas C Patel
*Assistant Examiner* — Phuongchi Nguyen
(74) *Attorney, Agent, or Firm* — Barley Snyder

(57) ABSTRACT

An electrical connector with contact locking bodies separate from a housing which are secured from accidentally falling off the housing and prevent foreign matters from entering the connector through a gap between the contact locking bodies or through gaps between the contact locking bodies and the housing. The electrical connector includes a lower housing having a recess that opens in an upper surface, a contact that passes through the recess of the lower housing in the front-rear direction and is received therein, a lance block that is received in the recess of the lower housing from above the upper surface and prevents the contact from falling off, and an upper housing that is positioned on the upper surface side of the lower housing to cover the lance block.

10 Claims, 5 Drawing Sheets

FIG. 4A
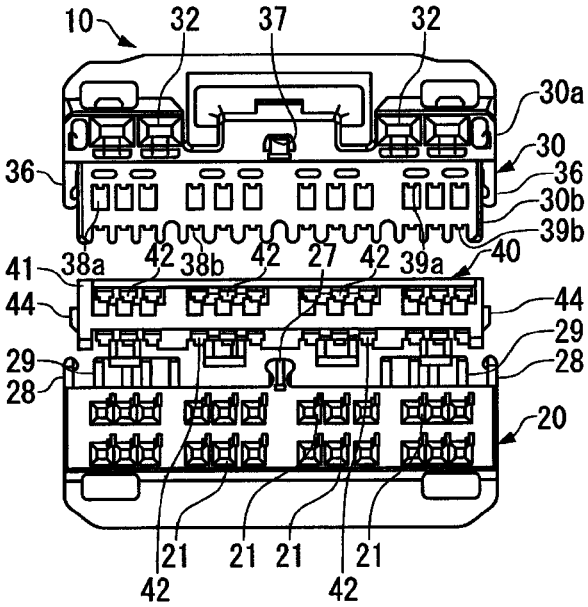
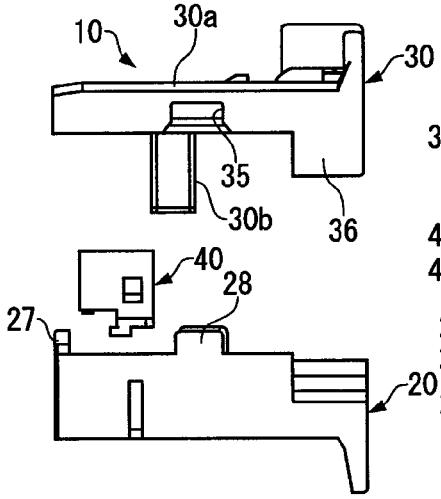
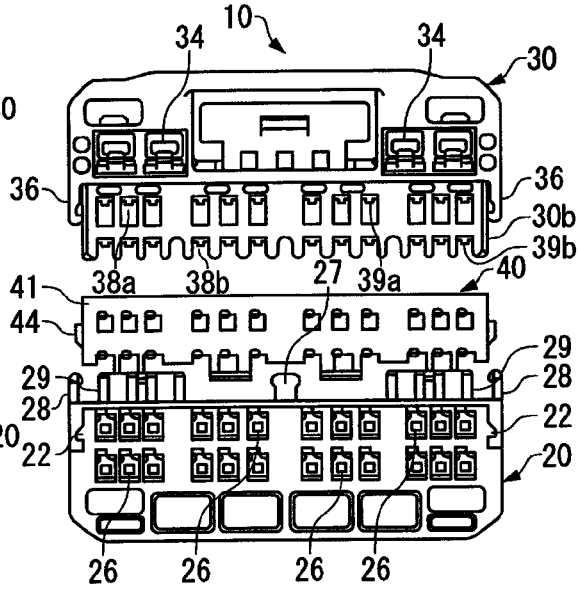
FIG. 4B
FIG. 4C

ELECTRICAL CONNECTOR

CROSS-REFERENCE TO RELATED APPLICATIONS

This application is a continuation of PCT International Application No. PCT/JP2009/006507 filed Dec. 1, 2009, which claims priority under 35 U.S.C. §119 to Japanese Patent Application No. JP 2008-332882, filed Dec. 26, 2008.

FIELD OF INVENTION

The present invention relates to an electrical connector and in particular to an electrical connector provided with a contact locking body prepared separately from a housing.

BACKGROUND

A connector used to electrically connect a circuit board and an electrical wire on an automobile is required to have as small dimensions as possible in both the vertical and horizontal directions, such that it has as small of height and width (pitch) as possible. The applicant has proposed in Japanese Patent Laid-Open No. 2007-324049 a connector that provides a sufficient contact holding force while meeting the requirement.

The connector disclosed in Japanese Patent Laid-Open No. 2007-324049 includes a housing having a front, a rear, an upper, a lower, a right and a left surface and a recess formed in the lower surface; a contact accommodated in the recess of the housing so as to extend from the rear surface side toward the front surface side; a lance block that is accommodated in the recess of the housing from the lower surface side to primarily lock the contact; and a side retainer that is accommodated in the recess of the housing from the lower surface side to secondarily lock the contact.

Due to the configuration described above, the connector disclosed in Japanese Patent Laid-Open No. 2007-324049 can provide a sufficient contact holding force even though the wall thickness of the housing is reduced to reduce the vertical and horizontal dimensions. In this specification, as in Japanese Patent Laid-Open No. 2007-324049, a body that primarily locks a contact is referred to as a lance, and a body that secondarily locks the contact is referred to as a retainer.

However, the lance block and the side retainer of the connector disclosed in Japanese Patent Laid-Open No. 2007-324049 are positioned side by side in the recess in the lower surface of the housing with the lower surfaces thereof exposed at the bottom of the housing. The lance block and the side retainer are satisfactorily locked even with such a configuration. However, the connector should be further improved in security if it is used in an automobile or the like.

A reason why the security should be further improved is because there is still an undeniable possibility that a relatively high impact exerted on the connector during use might force the lance block or the side retainer out of their respective normal positions in the housing. Besides, there are gaps between the lance block and the side retainer positioned side by side in the recess of the housing, between the housing and the lance block and between the housing and the side retainer, and foreign matters can enter the connector through the gaps.

SUMMARY

The present invention has been devised to solve the technical problems described above, and an object of the present invention, among others, is to provide a connector having contact locking bodies, such as a lance block and a side retainer, that are separate from a housing are prevented from accidentally falling off the housing and that foreign matters are prevented from entering the connector through a gap between the contact locking bodies or through gaps between the contact locking bodies and the housing.

The electrical connector includes a lower housing having a recess that opens in an upper surface, a contact that passes through the recess of the lower housing in the front-rear direction and is received therein, a lance block that is received in the recess of the lower housing from above the upper surface and prevents the contact from falling off, and an upper housing that is positioned on the upper surface side of the lower housing to cover the lance block.

BRIEF DESCRIPTION OF THE DRAWINGS

The invention is described in more detail in the following with reference to the embodiments shown in the drawings. Similar or corresponding details in the Figures are provided with the same reference numerals. The invention will be described in detail with reference to the following figures of which:

FIG. 4A is a front view of the connector according to the invention;

FIG. 4B is a side view of the connector according to the invention;

FIG. 4C is a rear view of the connector according to the invention; and

DETAILED DESCRIPTION OF THE DRAWINGS

Figure 1:
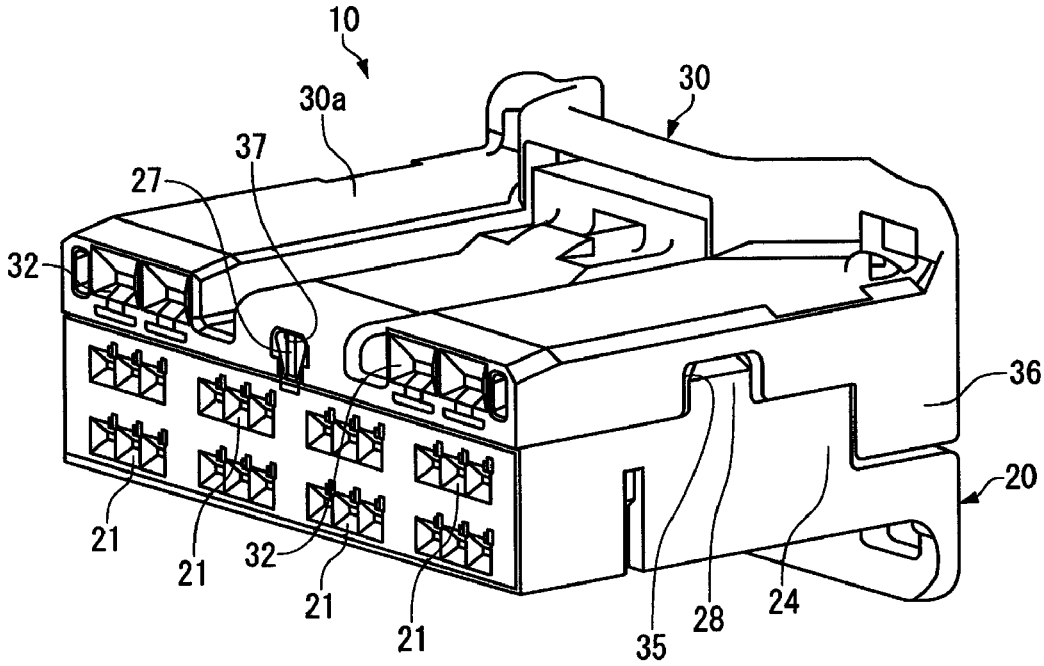
FIG. 1 is a perspective view of a connector according to the invention.

In the following, the present invention will be described in detail with regard to an embodiment shown in FIGS. 1 to 5.

A connector 10 according to an embodiment of the invention is used to electrically connect a circuit board and an electrical wire on an automobile, for example, and is mated with a mating connector not shown. The mating connector has a pin-shaped male contact, for example. Once the connector 10 and the mating connector are mated with each other, a female contact of the connector 10 receives the male contact of the mating connector to establish an electrical connection.

The connector 10 includes a lower housing 20, an upper housing 30 that covers the top of the lower housing 20 and is coupled to the lower housing 20, and a lance block 40 attached to the lower housing 20. In the following description, terms relating to the vertical direction are based on the vertical direction in FIGS. 1 to 4. And as for the front-rear direction, the side of the connector 10 at which it is coupled to the mating connector (not shown) (the side of the connector shown as the front in FIGS. 1 to 4) is the front side.

In the embodiment shown, the lower housing 20 has a rectangular parallelepiped shape and is integrally formed by injection molding of an insulating resin. The term integrally formed refers to a seamless member composed of a single component, and the integral member may be fixed to the housing in any manner, such as locking and adhesion.

The lower housing 20 has contact insertion openings 21 formed in the front end surface at which the connector 10 is mated with the mating connector, a male contact held in the mating connector being inserted into each contact insertion opening 21. The contact insertion openings 21 are arranged in a plurality of rows in the width direction and a plurality of columns in the vertical direction. To facilitate insertion of the mating contacts, the contact insertion openings 21 are sloped.

The lower housing 20 has a recess 23 that opens upward. The recess 23 has a enough volume to receive and accommodate a retainer 30*b* of the upper housing 30 described later and the lance block 40.

Contact receiving cavities (not shown) communicating with the contact insertion openings 21 are formed in the lower housing 20 in a part closer to the front than the recess 23. The contact receiving cavities open into the recess 23 at the rear end.

A contact receiving section 24 is formed in the lower housing 20 in a part closer to the rear than the recess 23. In the contact receiving section 24, first contact receiving cavities 25 are formed in a plurality of rows in the left-right (width) direction with predetermined pitches and in two columns in the vertical direction. The first contact receiving cavities 25 open into the recess 23 at the front end and open in the rear end surface of the lower housing 20 at the rear end; that is, pass through the contact receiving section 24 in the front-rear direction. The openings in the rear end surface constitute contact insertion openings 26.

A lock 27 is formed on the upper surface of the lower housing 20 at a position close to the front end. The lock 27 is fitted into a locking groove 37 formed in the upper housing 30. A pair of left and right locks 28 is formed on the upper surface of the lower housing 20 at opposite ends in the width direction. The locks 28 are fitted into a pair of left and right locking grooves 35 formed in the upper housing 30 at opposite ends in the width direction. The lock 27 is fitted into the locking groove 37 in the upper housing 30 and the locks 28 are fitted into the locking grooves 35 in the upper housing 30, thereby positioning the lower housing 20 and the upper housing 30 and coupling the housings to each other.

Locking protrusions 22 are formed on the opposite side surfaces of the lower housing 20 at positions close to the rear end. The locking protrusions 22 are engaged with locks 36 formed on the upper housing 30.

The lower housing 20 has first retainers 29, the third contact locking bodies, having a rectangular parallelepiped shape formed on the upper surface at positions to the rear of the recess 23. The first retainers 29 secondarily lock second contacts 52 (FIG. 5) held in the upper housing 30. Two (a pair of) first retainers 29 are used to secondarily lock one second contact 52. Once tip end parts of the first retainers 29 are inserted into locking grooves in the second contact 52, the second contact 52 is secondarily locked and prevented from falling off the upper housing 30. This locking mechanism is well known and thus will not be further described herein.

The upper housing 30, in the embodiment shown, is integrally formed by injection molding of an insulting resin and includes a contact receiving section 30*a* arranged at an upper position and a second retainer 30*b*, a second contact locking body.

The contact receiving section 30*a* has contact insertion openings 32 in the front end surface into which mating male contacts are inserted. Two of the contact insertion openings 32 are formed in the right side of the contact receiving section 30*a*, and two of the contact insertion openings 32 are formed in the left side of the contact receiving section 30*a*. In the contact receiving section 30*a*, contact receiving cavities communicating with the contact insertion openings 32 are formed to receive and hold the second contacts 52 therein. In the contact accommodating cavity, a lance is formed integrally with the upper housing 30. The second contact 52 is primarily locked by the housing lance. This locking mechanism is well known and thus will not be further described herein. The contact accommodating cavity passes through the contact receiving section 30*a* to the rear end surface and forms a contact insertion opening 34.

The locking grooves 35, into which the locks 28 of the lower housing 20 are fitted, are formed in the middle part in the front-rear direction of the left and right side surfaces of the contact receiving section 30*a*.

In addition, the contact receiving section 30*a* has locks 36 extending downward from the left and right side surfaces of the rear end part thereof. A locking groove 36*g* extending in the front-rear direction is formed in the inner surface of the lock 36.

The locking groove 37, into which the lock 27 of the lower housing 20 is fitted, is formed in the lower surface of the front end part of the contact receiving section 30*a*.

The retainer 30*b* includes contact receiving cavities 38*a* and contact insertion grooves 38*b* formed below the contact receiving cavities 38*a*. Once the connector 10 is assembled, the contact receiving cavities 38*a* are aligned in the front-rear direction with the contact insertion openings 21 arranged in the upper part of the lower housing 20. Similarly, the contact insertion grooves 38*b* are aligned in the front-rear direction with the contact insertion openings 21 arranged in the lower part of the lower housing 20.

A retainer protrusion 39*a* extending downward is formed on the upper surface of the contact receiving cavity 38*a*. A retainer protrusion 39*b* extending downward is formed on the upper surface of the contact insertion groove 38*b*. When the lower housing 20 and the upper housing 30 are in a fully locked state, the retainer protrusion 39*a* and the retainer protrusion 39*b* are each fitted into a locking groove formed in their corresponding first contacts 51 to secondarily lock the first contacts 51.

The lance block 40, the first contact locking body, is inserted into the recess 23 of the lower housing 20 from above the upper surface of the lower housing 20 and accommodated therein to primarily lock the first contacts 51.

The lance block 40 has a base 41 that extends in the left-right direction and has dimensions that can be received in the recess 23 of the lower housing 20. The lance block 40 is integrally formed by injection molding of an insulating resin.

The base 41 has a plurality of resilient lances 42 arranged in the vertical direction and the left-right direction with the same pitches as the contact insertion openings 21 of the lower housing 20. The resilient lance 42 is a member that primarily locks the first contact 51.

Referring to the drawings, first contact receiving cavities 43 into which the first contacts 51 are inserted are formed below the resilient lances 42 arranged in the upper part. The first contact receiving cavities 43 pass through the base 41 in the front-rear direction. As shown in the drawings, there are open spaces below the resilient lances 42 arranged in the lower part. Once the lance block 40 is received in a predetermined position in the recess 23 of the lower housing 20, a gap is formed between the resilient lances 42 and the bottom wall of the lower housing 20, and the first contacts 51 are accommodated in the gap.

A locking protrusion 44 is formed on each of the side surfaces of the lance block 40. Once the lance block 40 is received in a predetermined position in the recess 23 of the lower housing 20, the locking protrusions 44 are fitted into locking grooves (not shown) formed in the left and right inner surfaces of the lower housing 20, thereby positioning the lance block 40 with respect to the lower housing 20 and restricting movement of the lance block 40.

Figure 5:
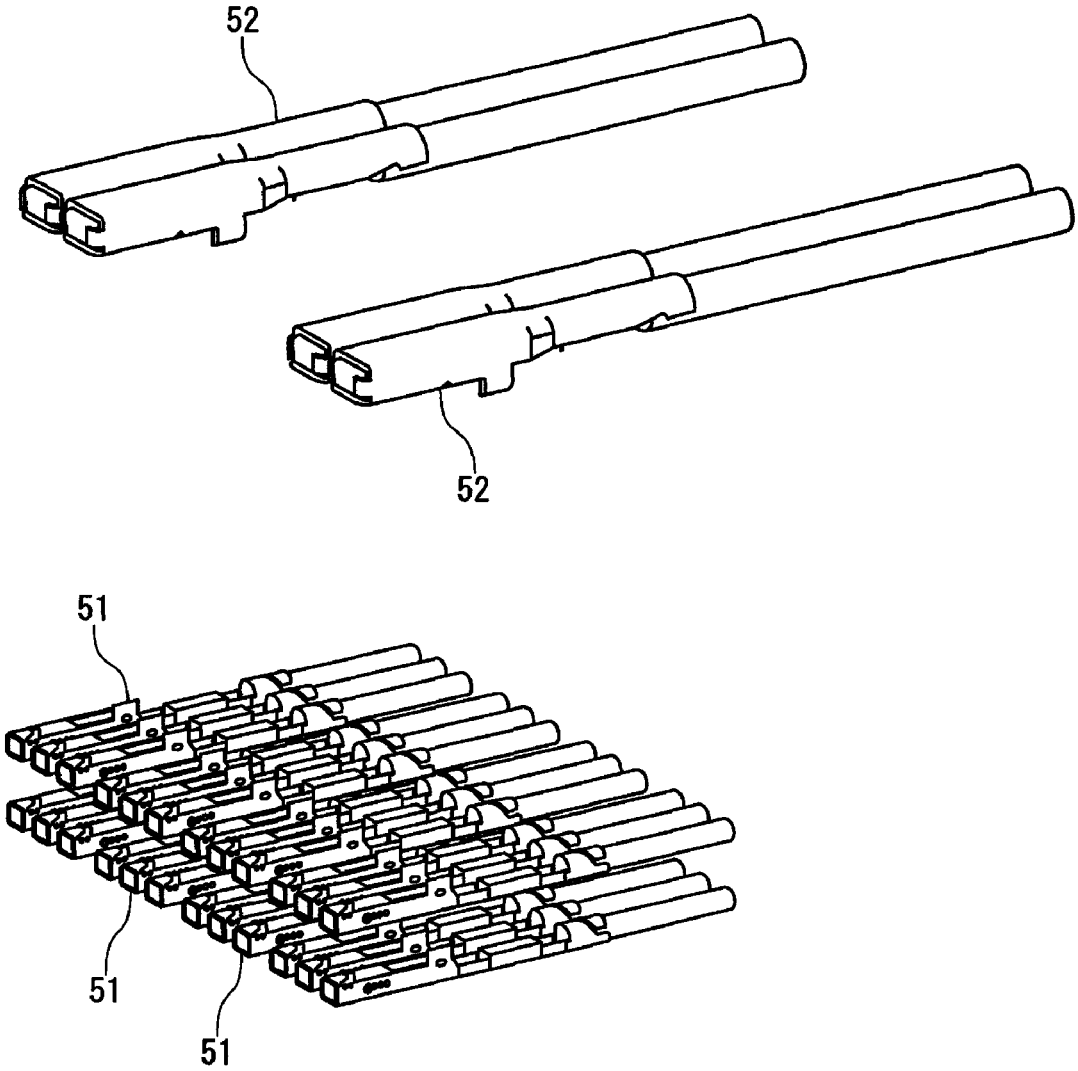
FIG. 5 is a perspective view of a first contact and a second contact of the connector according to the invention.

As shown in FIG. 5, the first contact 51 and the second contact 52 are both female contacts. That is, the first contact 51 and the second contact 52 are formed by punching a piece of a certain size out of a thin metal plate, bending the punched piece and shaping the front end part into a box-like shape, so that the mating male contact can be inserted into the contact.

The first contact 51 received in the lower housing 20 is of size 0.5, and the second contact 52 accommodated in the upper housing 30 is of size 1.5. That is, the second contact 52 is larger than the first contact 51.

Next, a method of assembly of the connector 10 will be described.

Figure 3:
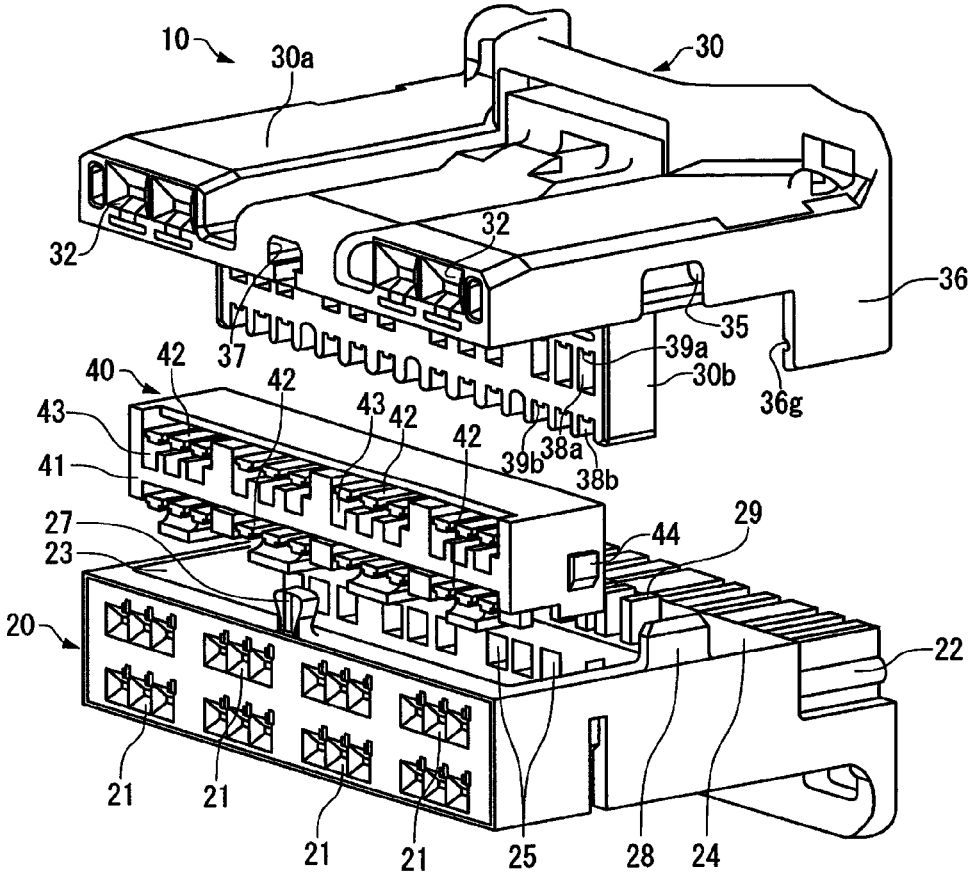
FIG. 3 is an exploded perspective view of the connector according to the invention with the lance block removed from the lower housing.

First, in the state shown in FIG. 3, the lance block 40 is inserted into the recess 23 of the lower housing 20 from above the upper surface of the lower housing 20. In this process, the locking protrusions 44 on the lance block 40 are fitted into the locking grooves formed in the left and right inner surfaces of the lower housing 20, thereby fixing the lance block 40 in a predetermined position in the lower housing 20.

Figure 2:
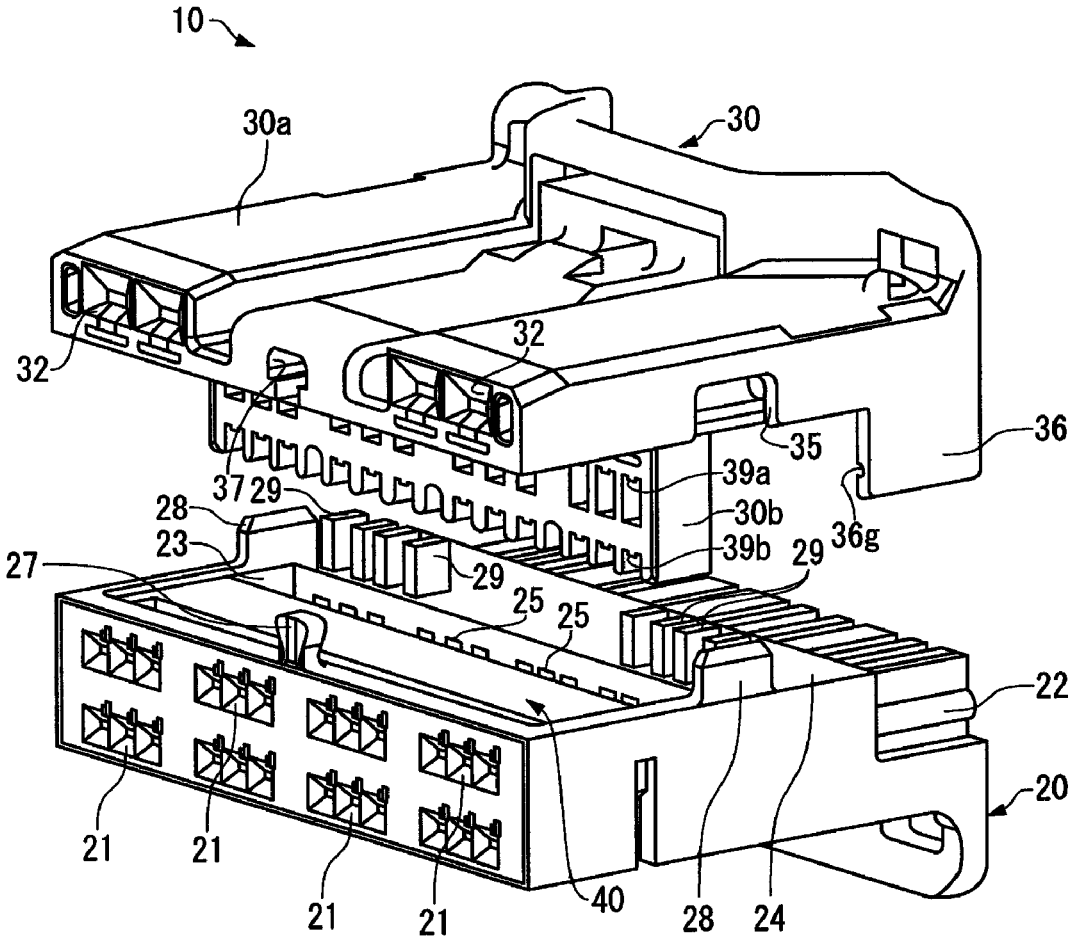
FIG. 2 is an exploded perspective view of the connector according to the invention with a lance block assembled into a lower housing.

Once the lance block 40 is accommodated in the predetermined position in the recess 23 of the lower housing 20 as shown in FIG. 2, the contact receiving cavities of the lower housing 20, the first contact receiving cavities 43 of the lance block 40 and the first contact receiving cavities 25 of the lower housing 20 are aligned with each other in the front-rear direction.

Although the lance block 40 occupies the front part of the recess 23, the rear part of the recess 23 remains unoccupied and provides a space into which the retainer 30*b* of the upper housing 30 is inserted.

Then, in order that the retainer 30*b* is inserted into the space of the rear part of the recess 23 of the lower housing 20, the upper housing 30 is pushed down to a half locked position where the locks 36 of the contact receiving section 30*a* come into contact with the top of the locking protrusions 22 of the lower housing 20. In the half locked position, the contact receiving cavities of the lower housing 20, the first contact receiving cavities 43 of the lance block 40, the contact receiving cavities 38*a* (38*b*) of the retainer 30*b*, and the first contact receiving cavities 25 of the lower housing 20 are aligned with each other in the front-rear direction.

When the lower housing 20 and the upper housing 30 are in the half locked position, each first contact 51 is inserted forward into the contact insertion opening 26 in the rear end surface of the lower housing 20. The first contact 51 passes through the contact insertion opening 26, the contact receiving cavities 38*a* (38*b*) of the retainer 30*b*, and the first contact receiving cavities 43 of the lance block 40 and is accommodated therein. At this point in time, each first contact 51 is primarily locked by the resilient lance 42 of the lance block 40.

In addition, each second contact 52 is inserted forward into the contact insertion opening 34 in the rear end surface of the upper housing 30 to a predetermined position in the contact receiving cavities. Each second contact 52 is primarily locked by the housing lance of the upper housing 30.

Once insertion of the first contacts 51 and the second contacts 52 is completed, the upper housing 30 is further pushed toward the lower housing 20 to a fully locked position. In the fully locked position, the tip ends of the locks 36 of the upper housing 30 have passed beyond the locking protrusions 22 of the lower housing 20, and the locking protrusions 22 are fitted in the locking grooves 36*g*. In addition, the locks 28 of the lower housing 20 are fitted in the locking grooves 35 of the upper housing 30. In this way, the upper housing 30 and the lower housing 20 are coupled and fixed to each other.

In the fully locked position, the first retainers 29 of the lower housing 20 secondarily lock the second contacts 52 received in the upper housing 30 to prevent the second contacts 52 from falling off. In addition, the retainer protrusions 39*a* and 39*b* of the upper housing 30 secondarily lock the first contacts 51 accommodated in the lower housing 20 to prevent the first contacts 51 from falling off.

The connector 10 is assembled in this way.

For the connector 10 according to the shown embodiment, since the upper housing 30 covers the lower housing 20, the possibility that the lance block 40 falling off is extremely low, and there is no possibility that foreign matters may enter the connector 10. In addition, for the connector 10, since the upper housing 30 is used as the member that covers the lance block 40, falling off of the lance block 40 and entry of foreign matters can be advantageously prevented even if the number of contact poles increases.

For the connector 10, the second contacts 52 received in the upper housing 30 are larger than the first contacts 51 accommodated in the lower housing 20, and the lances (housing lances) for primarily locking the second contacts 52 are formed integrally with the upper housing 30. Therefore, the second contacts 52 do not need a separate member equivalent to the lance block 40, so that the connector 10 can advantageously be composed of a reduced number of parts. Note that the lances (housing lances) for primary locking formed integrally with the upper housing 30 are only a preferred embodiment of the present invention but do not limit the scope of the present invention.

For the connector 10, the retainer 30*b* that secondarily locks the first contacts 51 is formed integrally with the upper housing 30, and the first retainers 29 that secondarily lock the second contacts 52 are formed integrally with the lower housing 20. Therefore, there is no need to prepare retainers separate from the housings, the connector 10 can further advantageously be composed of a reduced number of parts. However, note that the retainer 30*b* formed integrally with the upper housing 30 and the first retainers 29 formed integrally with the lower housing 20 are only one embodiment of the present invention, and the retainer 30*b* or the first retainers 29 may be formed separately from the housing according to the present invention.

For the connector 10, the first contacts 51 and the second contacts 52 differ in size from each other, so that the positions at which the first contacts 51 are locked by the retainer 30*b* and the positions at which the second contacts 52 are locked by the first retainers 29 can be displaced in the front-rear direction.

If the first contacts 51 and the second contacts had the same size, the positions where the first and second contacts are locked by their respective retainers in the front-rear direction would substantially correspond with each other. In particular, for smaller first contacts 51 and the second contacts 52, the areas of the contacts available for locking by their respective retainers are limited, so that the retainers for secondary locking cannot be positioned without interfering with each other. That is, this arrangement is not practical. To the contrary, for the connector 10, since the first contacts 51 and the second contacts 52 have different sizes, the positions at which the first contacts 51 are locked and the positions at which the second contacts 52 are locked can be displaced in the front-rear direction.

Although an embodiment of the present invention has been described above, any member that covers the lance block 40 can be used as an alternative to the upper housing 30.

The contacts received in the lower housing 20 are not necessarily arranged in two, upper and lower, rows but may be arranged in one row or three or more rows. The same holds true for the upper housing 30. Furthermore, the contacts accommodated in the lower housing 20 and the upper housing 30 may be male contacts.

Furthermore, some of the components described in the above embodiment may be omitted, combined in other ways, or modified without departing from the spirit of the present invention.

What is claimed is:

1. An electrical connector, comprising:

a first housing having an upper surface, a lower surface, and a recess that opens in one of the upper and lower surfaces;

a first contact that is received in the recess of the first housing;

a first contact locking body that is received in the recess of the first housing from a side of the one of the upper and lower surfaces and prevents the first contact from falling off; and a second housing that covers the first contact locking body from the side of the one of the upper and lower surfaces; and a second contact that is received in the second housing.

2. The electrical connector according to claim 1, wherein a third contact locking body that prevents falling off of the second contact is formed integrally with the first housing.

3. The electrical connector according to claim 2, wherein the third contact locking body is another retainer having a rectangular parallelepiped shape formed on the upper surface at positions to the rear of the recess.

4. The electrical connector according to claim 1, wherein the first contact locking body is a lance block having a base that is received in the recess of the first housing.

5. The electrical connector according to claim 4, wherein the second contact received in the second housing is larger than the first contact received in the first housing.

6. The electrical connector according to claim 4, wherein a second contact locking body that further prevents the first contact from falling off is formed integrally with the second housing.

7. The electrical connector according to claim 6, wherein the second contact locking body is a retainer having contact receiving cavities and contact insertion grooves formed below the contact receiving cavities.

8. The electrical connector according to claim 6, wherein a third contact locking body that prevents falling off of the second contact is formed integrally with the first housing.

9. The electrical connector according to claim 8, wherein a position at which the first contact is locked by the second contact locking body and a position at which the second contact is locked by the third contact locking body are displaced in a front-rear direction.

10. The electrical connector according to claim 9, wherein the second contact locking body is a retainer having contact receiving cavities and contact insertion grooves formed below the contact receiving cavities, and the third contact locking body is another retainer having a rectangular parallelepiped shape formed on the upper surface at positions to the rear of the recess.

* * * * *